US006826903B2

(12) United States Patent
Yahata et al.

(10) Patent No.: US 6,826,903 B2
(45) Date of Patent: Dec. 7, 2004

(54) EXHAUST GAS RECIRCULATION SYSTEM HAVING COOLER

(75) Inventors: Shigeto Yahata, Kariya (JP); Makoto Saito, Okazaki (JP); Masumi Kinugawa, Okazaki (JP); Kiyonori Sekiguchi, Okazaki (JP); Tsukasa Kuboshima, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/440,140

(22) Filed: May 19, 2003

(65) Prior Publication Data

US 2003/0213230 A1 Nov. 20, 2003

(30) Foreign Application Priority Data

May 20, 2002 (JP) ..... 2002-144784

(51) Int. Cl.[7] ..... F01N 3/00

(52) U.S. Cl. ..... 60/278; 60/277; 60/280; 60/298; 60/320; 60/605.2; 123/568.12; 123/568.16; 123/568.22

(58) Field of Search ..... 60/277, 278, 280, 60/295, 298, 320, 605.2; 123/568.12, 568.16, 568.18, 568.19, 568.22

(56) References Cited

U.S. PATENT DOCUMENTS 6,161,528 A * 12/2000 Akao et al. ..... 123/568.12
6,708,487 B2 * 3/2004 Morimoto et al. ..... 60/311
6,725,832 B2 * 4/2004 Yokoyama et al. ..... 123/396

FOREIGN PATENT DOCUMENTS

| | | | | |
|---|---|---|---|---|
| JP | 11093781 A | * | 4/1999 | ..... 60/278 |
| JP | 11-125153 | | 5/1999 | |
| JP | 02000130266 A | * | 5/2000 | ..... 60/605.2 |
| JP | 2000-213426 | | 8/2000 | |
| JP | 2001289125 A | * | 10/2001 | ..... 60/278 |
| JP | 2002-174148 | | 6/2002 | |

* cited by examiner

*Primary Examiner*—Binh Q. Tran
(74) *Attorney, Agent, or Firm*—Nixon & Vanderhye P.C.

(57) ABSTRACT

An exhaust gas recirculation (EGR) system of an internal combustion engine has an EGR cooler in an EGR passage connecting an exhaust manifold with an intake manifold. The EGR cooler cools EGR gas recirculated through the EGR passage. Cooling performance detecting means included in an electronic control unit (ECU) determines that cooling performance of the EGR cooler is degraded when intake pressure measured by an intake pressure sensor is lower than a normal intake pressure by at least a predetermined value. When the degradation of the cooling performance is detected, cooling performance regeneration controlling means included in the ECU increases the temperature inside the EGR cooler by heating the exhaust gas to eliminate soot or unburned hydrocarbon by oxidization. Thus, the cooling performance of the EGR cooler is regenerated.

16 Claims, 15 Drawing Sheets

EXHAUST GAS RECIRCULATION SYSTEM HAVING COOLER

CROSS REFERENCE TO RELATED APPLICATION

This application is based on and incorporates herein by reference Japanese Patent Application No. 2002-144784 filed on May 20, 2002.

BACKGROUND OF THE INVENTION

1. Field of the Invention

The present invention relates to an exhaust gas recirculation (EGR) system having an EGR cooler in an EGR passage, through which part of exhaust gas is recirculated to an intake passage. The EGR cooler cools the recirculated exhaust gas.

2. Description of Related Art

An exhaust gas recirculation system (EGR system) is commonly used for reducing emission of a diesel engine. The EGR system recirculates part of exhaust gas to an intake passage. EGR gas, which is the exhaust gas recirculated to the intake passage, includes much inert gas such as vapor or carbon dioxide, which is generated in combustion. An advantage of the EGR system is that generation of nitrogen oxide is inhibited because combustion temperature is decreased. If an EGR cooler is disposed in an EGR passage for cooling the EGR gas, charging efficiency of the EGR gas is improved, and the emission-reducing effect is further improved.

However, if the EGR system is used for a long time, soot or unburned hydrocarbon included in the EGR gas may adhere and deposit onto a heat exchanging part of the EGR cooler. The deposition of the soot or the hydrocarbon decreases heat-exchanging efficiency and cooling performance. As a result, the emission-reducing effect is decreased.

SUMMARY OF THE INVENTION

It is therefore an object of the present invention to eliminate soot or unburned hydrocarbon adhering to a heat-exchanging part of an exhaust gas recirculation (EGR) cooler of an EGR system for an internal combustion engine. Thus, degradation of cooling performance is prevented, and a high emission-reducing effect is maintained for a long time.

According to an aspect of the present invention, an exhaust gas recirculation (EGR) system of an internal combustion engine has an EGR cooler disposed in an EGR passage. The EGR passage connects an exhaust passage with an intake passage in order to recirculate part of exhaust gas. The EGR cooler cools EGR gas passing through the EGR passage. The EGR system has cooling performance detecting means and cooling performance regeneration controlling means. The cooling performance detecting means detects cooling performance of the EGR cooler. The cooling performance regeneration controlling means performs a regenerating operation for regenerating the cooling performance when degradation of the cooling performance is detected.

Thus, the EGR cooler can maintain excellent heat-exchanging performance even if the EGR cooler is used for a long time. As a result, an emission-reducing effect is maintained for a long time.

The EGR system has intake pressure measuring means for measuring an intake pressure. The cooling performance detecting means determines that the cooling performance is degraded when the intake pressure measured by the intake pressure measuring means is lower than a normal intake pressure by at least a predetermined value. The normal intake pressure is estimated from an operating state of the engine. If the unburned ingredients such as the soot deposit on the EGR cooler, a passage area and a flow rate of the EGR gas are decreased. Accordingly, the intake pressure decreases. Therefore, the degradation of the cooling performance can be determined based on the decrease in the intake pressure.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENTS

(First Embodiment)

Figure 1:
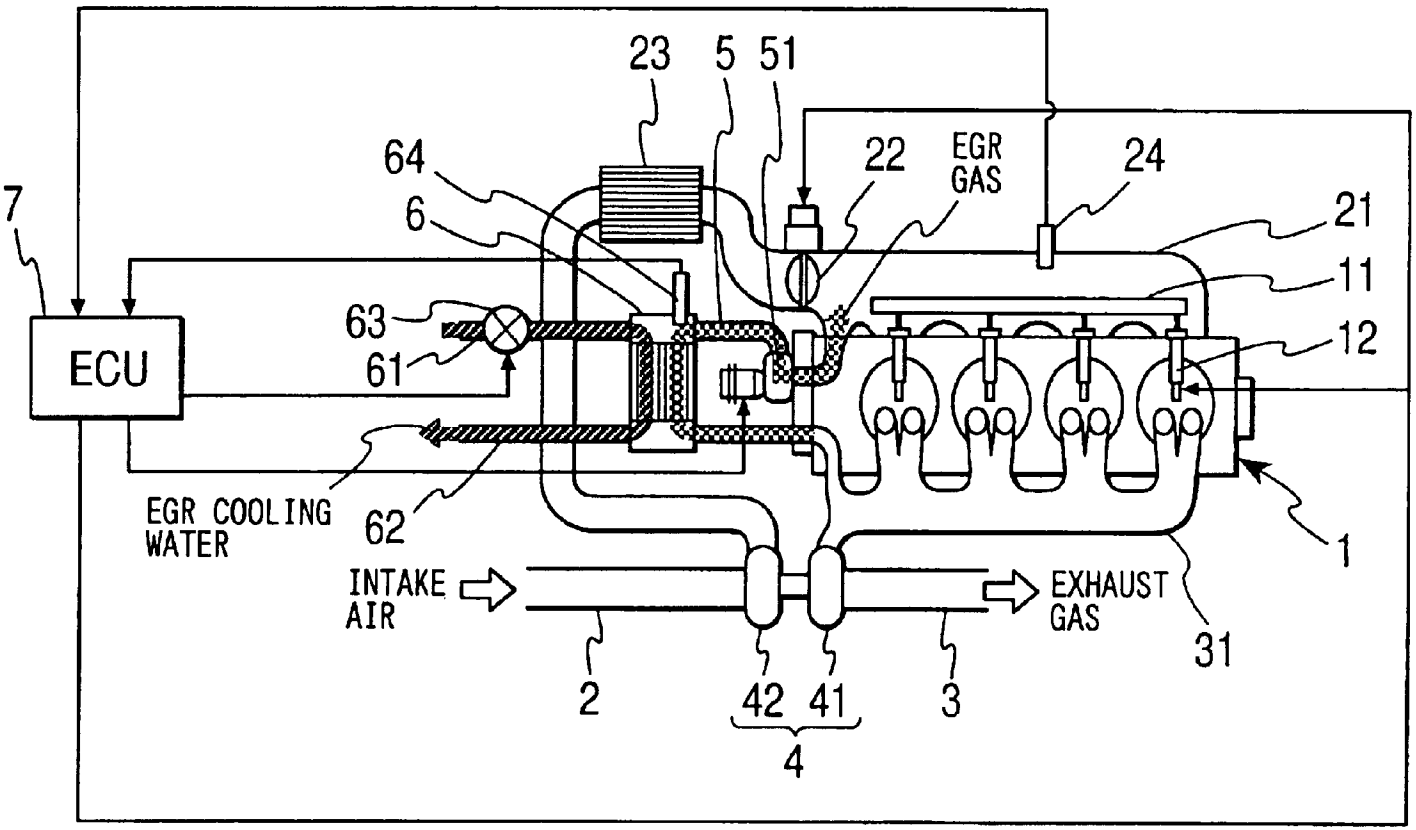
FIG. 1 is a schematic diagram showing an internal combustion engine having an exhaust gas recirculation (EGR) system according to a first embodiment of the present invention.

Referring to FIG. 1, an engine 1 having an exhaust gas recirculation system according to the first embodiment is illustrated. The engine 1 has a common rail 11, which is common to respective cylinders of the engine 1, and fuel injection valves 12. Each fuel injection valve 12 is connected with the common rail 11 and injects fuel into a combustion chamber of each cylinder of the engine 1. An intake manifold 21 of the engine 1 is connected with an intake pipe 2. An intake throttle 22 is disposed at the connection between the intake manifold 21 and the intake pipe 2. The intake throttle 22 regulates a flow rate of intake air.

An exhaust manifold 31 of the engine 1 is connected with an exhaust pipe 3. A turbine 41 of a centrifugal supercharger 4 is disposed in the exhaust pipe 3. A compressor 42 is disposed in the intake pipe 2. The turbine 41 is connected with the compressor 42 through a turbine shaft. The turbine 41 is driven with the use of thermal energy of the exhaust gas. Meanwhile, the compressor 42 is driven by the turbine 41 through the turbine shaft and compresses the intake air, which is introduced into the intake pipe 2. A cooler 23 is disposed in the intake pipe 2 and upstream of the intake throttle 22. The intake air, which is compressed and heated at the compressor 42, is cooled at the cooler 23.

The exhaust manifold 31 is connected with the intake manifold 21 through an exhaust gas recirculation (EGR) passage 5 so that part of the exhaust gas is recirculated into the intake air through the EGR passage 5. An EGR valve 51 is disposed at an outlet of the EGR passage 5 to the intake manifold 21. The EGR valve 51 regulates its opening degree to regulate a quantity of the exhaust gas recirculated into the intake air. The intake manifold 21 has an intake pressure sensor 24 as intake pressure measuring means for measuring an intake pressure.

An EGR cooler 6 is disposed in the EGR passage 5 for cooling the recirculated exhaust gas (EGR gas). The EGR cooler 6 has a publicly known structure. The EGR cooler 6 has a heat-exchanging part. In the heat-exchanging part, a multiplicity of gas passages through which the EGR gas passes is formed in parallel with each other, and a multiplicity of water passages through which EGR cooling water passes is formed. Each water passage is formed in connection with each gas passage. The water passages are connected with an EGR cooling water introduction pipe 61 and an EGR cooling water discharge pipe 62. An EGR cooling water valve 63 such as an electromagnetic valve is disposed in the EGR cooling water introduction pipe 61 for opening or closing the the passage of the EGR cooling water. A temperature sensor 64 is disposed as temperature measuring means for measuring an EGR gas temperature at an outlet of the EGR cooler 6.

An electronic control unit (ECU) 7 outputs signals for controlling the opening degree of the EGR valve 51 and the opening or closing of the EGR cooling water valve 63. If the EGR valve 51 and the EGR cooling water valve 63 are open, the EGR gas exchanges heat with the EGR cooling water while passing through the EGR cooler 6. Thus, the EGR gas is introduced to the intake manifold 21 while the EGR gas is cooled and its volume is reduced. Therefore, the temperature of the intake air is not increased unnecessarily when the EGR gas is mixed with the intake air. As a result, the effect of the exhaust gas recirculation for reducing the combustion temperature is exerted efficiently. The ECU 7 receives signals from various sensors for measuring the valve-opening degree of the EGR valve 51, the opening degree of the intake throttle 22, an intake air flow rate, cooling water temperature, a crank angle, a rotation speed, an accelerator position, a fuel pressure and the like. Thus, the ECU 7 detects an operating state of the engine 1. The ECU 7 feedback-controls the EGR valve 51, the fuel injection valves 12 and the like by calculating an optimum flow rate of the EGR gas and a fuel injection quantity in accordance with the operating state of the engine 1.

The EGR gas includes soot or unburned hydrocarbon included in the exhaust gas discharged from the combustion chamber. Therefore, while the EGR system is used for a long time, the soot or the unburned hydrocarbon may deposit on passage walls of the EGR cooler 6. As a result, the heat-exchanging performance may be degraded. Therefore, in the embodiment, the ECU 7 has cooling performance detecting means for detecting the cooling performance of the EGR cooler 6 based on an EGR outlet gas temperature of the EGR cooler 6. The EGR outlet gas temperature is the temperature of the EGR gas at an outlet of the EGR cooler 6, and is measured with a temperature sensor 64. The ECU 7 has cooling performance regeneration controlling means for performing a regenerating operation for regenerating the cooling performance based on the result of the detection of the cooling performance. More specifically, the cooling performance detecting means determines that the cooling performance is degraded when the EGR outlet gas temperature is higher than a normal temperature by at least a predetermined temperature. The normal temperature is estimated from the operating state of the engine 1, which is detected based on the signals from the various sensors.

Figure 2:
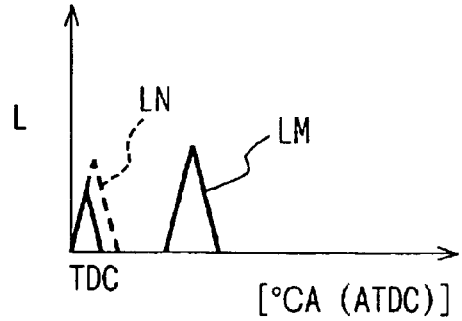
FIG. 2 is a time chart showing a lifting degree of a fuel injection nozzle according to the first embodiment.

The cooling performance regeneration controlling means increases temperature in the EGR cooler 6 temporarily when the cooling performance detecting means determines that the cooling performance is degraded. Thus, the soot or the unburned fuel adhering to EGR passage walls, the inner walls of the EGR passage 5 including the EGR cooler 6, are oxidized and eliminated, and the cooling performance is regenerated. In order to increase the temperature in the EGR cooler 6, the temperature of the exhaust gas is increased by performing a multi-injection when the fuel is injected into the combustion chamber with the fuel injection valves 12 as shown in FIG. 2. In the multi-injection, the fuel is injected multiple times during a combustion cycle. In FIG. 2, a solid line LM shows a nozzle lifting degree of a fuel injection nozzle in a case in which the multi-injection is performed and a dotted line LN shows a nozzle lifting degree in a case in which a normal injection is performed. In the case in which the multi-injection is performed, substantially most part of energy generated by the combustion of the fuel injected in the second injection is converted into thermal energy (not into motive energy). It is because the fuel injected in the second injection is ignited at retarded timing. Therefore, high-temperature (300 to 700° C.) exhaust gas can be generated and introduced into the EGR cooler 6. The temperature of the exhaust gas when the normal injection is performed is generally 150 to 400° C.

Figure 3:
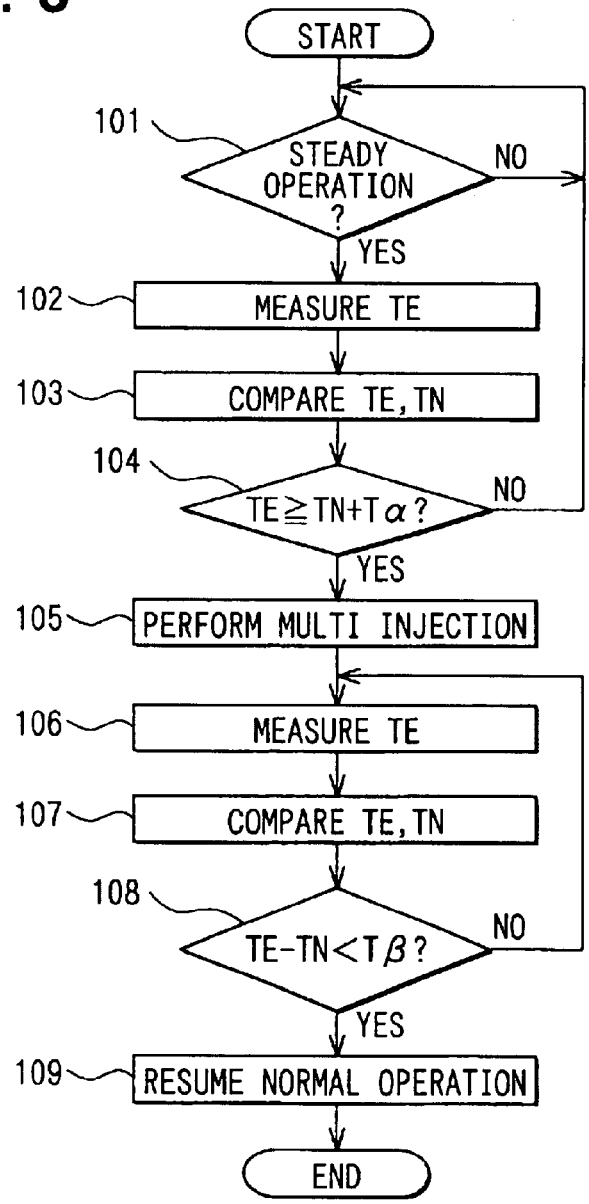
FIG. 3 is a flowchart showing control performed by an electronic control unit (ECU) according to the first embodiment.

A processing performed by the ECU 7 according to the first embodiment will be explained based on a flowchart shown in FIG. 3. The ECU 7 repeatedly performs the processing at predetermined time intervals. If the processing is started, it is determined whether the engine 1 is in a steady operating state or not in Step 101. Whether the engine 1 is in the steady operating state or not is determined based on whether a change of the engine rotation speed or the fuel injection quantity from the previous processing is less than a predetermined value or not, for instance. If the result of Step 101 is "YES", the processing proceeds to Step 102, and the EGR outlet gas temperature TE measured by the temperature sensor 64 is inputted. If the result of Step 101 is "NO", the processing returns to the start (START).

The EGR outlet gas temperature TE inputted in Step 102 is compared with a normal EGR outlet gas temperature TN in Step 103. The ECU 7 estimates in advance the EGR outlet gas temperature in a state in which there is no soot or hydrocarbon adhering to the EGR cooler 6, and stores the estimated EGR outlet gas temperature as the normal EGR outlet gas temperature TN. Then, in Step 104, it is determined whether the measured EGR outlet gas temperature TE is higher than the normal EGR outlet gas temperature TN by at least a predetermined value $T\alpha$ or not. If the result of Step 104 is "YES", it is determined that the cooling performance of the EGR system is degraded and the processing proceeds to Step 105. If the result of Step 104 is "NO", it is determined that the EGR cooler 6 is operating normally, and the processing returns to the start.

In Step 105, the ECU 7 sends an injection signal to the fuel injection valves 12 so that the fuel injection valves perform the multi-injection as shown in FIG. 2. Thus, the exhaust gas is heated and the high-temperature exhaust gas is introduced to the EGR cooler 6. Thus, the oxidization of the soot or the unburned hydrocarbon adhering to the EGR passage walls is promoted, and the oxides are led to the intake system with the exhaust gas. Then, in Step 106, the EGR outlet gas temperature TE is measured and inputted again. Then, in Step 107, the measured EGR outlet gas temperature TE is compared with the normal EGR outlet gas temperature TN. Then, in Step 108, it is determined whether a difference between the measured EGR outlet gas temperature TE and the normal EGR outlet gas temperature TN is less than another predetermined value $T\beta$ or not. If the result of Step 108 is "YES", it is determined that the soot or the unburned hydrocarbon is eliminated by the oxidization, and that the cooling performance is regenerated. Then in Step 109, the normal operation is resumed, and the processing is ended. If the result of Step 108 is "NO", Step 106 and the following steps are repeated.

(Second Embodiment)

Figure 4A:
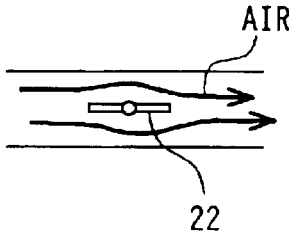
FIG. 4A is a schematic diagram showing an intake throttle of an internal combustion engine having an EGR system according to a second embodiment of the present invention in a state in which the intake throttle is at a usual position.
Figure 4B:
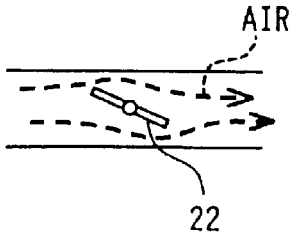
FIG. 4B is a schematic diagram showing the intake throttle according to the second embodiment in a state in which the intake throttle is rotated toward valve-closing direction.
Figure 5:
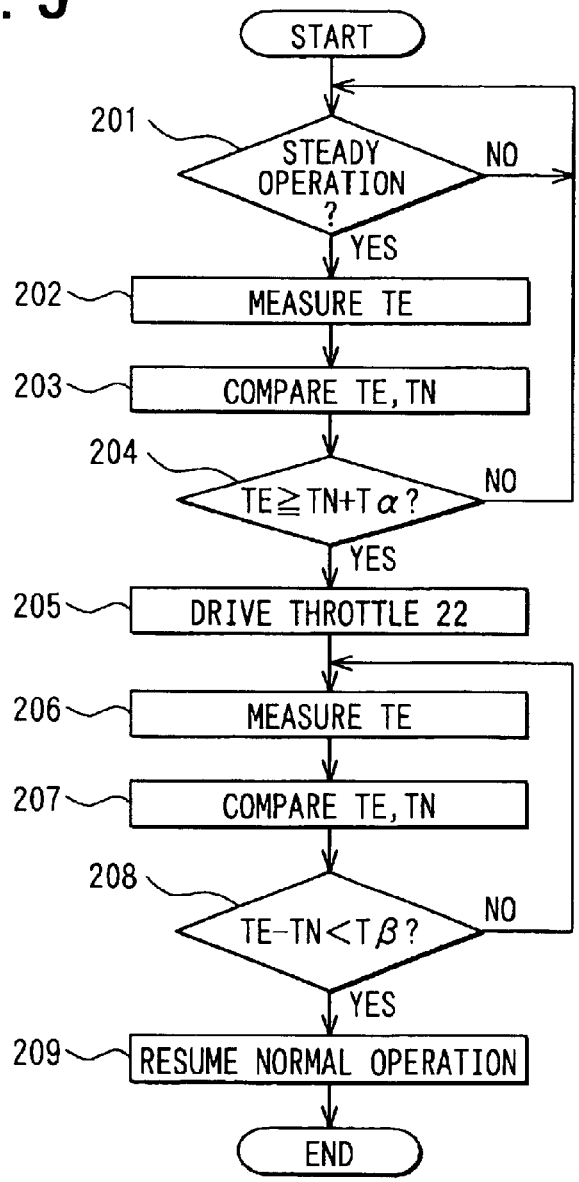
FIG. 5 is a flowchart showing control performed by an ECU according to the second embodiment.

An internal combustion engine 1 having an EGR system according to the second embodiment is illustrated in FIGS. 4A, 4B and 5. In the EGR system according to the second embodiment, the intake throttle 22 is rotated toward a closing direction from a usual position when the exhaust gas is heated to regenerate the cooling performance of the EGR cooler 6 as shown in FIGS. 4A and 4B. FIG. 4A shows a state in which the intake throttle 22 is at the usual position. FIG. 4B shows a state in which the intake throttle 22 is rotated toward the closing direction from the usual position. Thus, the flow rate of the intake air is decreased and thermal capacity of the gas entering the combustion chamber of the engine 1 is reduced. As a result, the exhaust gas is heated to a temperature at which the soot and the unburned hydrocarbon are oxidized and eliminated.

Next, a processing performed by the ECU 7 according to the second embodiment will be explained based on a flowchart shown in FIG. 5. First, in Step 201, it is determined whether the engine 1 is in the steady operating state or not. If the result of Step 201 is "YES", the processing proceeds to Step 202 and the EGR outlet gas temperature TE is measured. Then, in Step 203, the measured EGR outlet gas temperature TE is compared with the normal EGR outlet gas temperature TN. Then, in Step 204, it is determined whether the cooling performance is degraded or not like the first embodiment. If the result of Step 204 is "YES", the processing proceeds to Step 205.

In Step 205, the ECU 7 drives the intake throttle 22 toward the closing direction from the usual position, in order to reduce the flow rate of the intake air and to increase the temperature of the exhaust gas. Thus, the high-temperature exhaust gas is introduced to the EGR cooler 6, and the soot and the unburned hydrocarbon are eliminated by the oxidization. Then, in Step 206, the EGR outlet gas temperature TE is measured again. Then, in Step 207, the measured EGR outlet gas temperature TE is compared with the normal EGR outlet gas temperature TN. Then, in Step 208, it is determined whether the cooling performance is regenerated or not like the first embodiment. If the result of Step 208 is "YES", the normal operation is resumed in Step 209, and the processing is ended.

(Third Embodiment)

Figure 6:
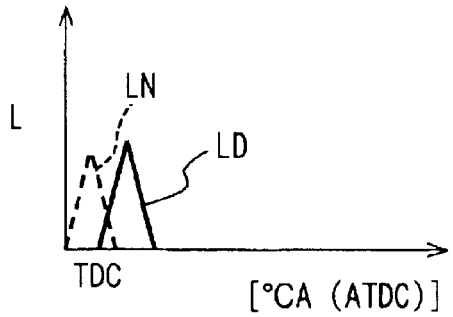
FIG. 6 is a time chart showing a lifting degree of a fuel injection nozzle of an internal combustion engine having an EGR system according to a third embodiment of the present invention.
Figure 7:
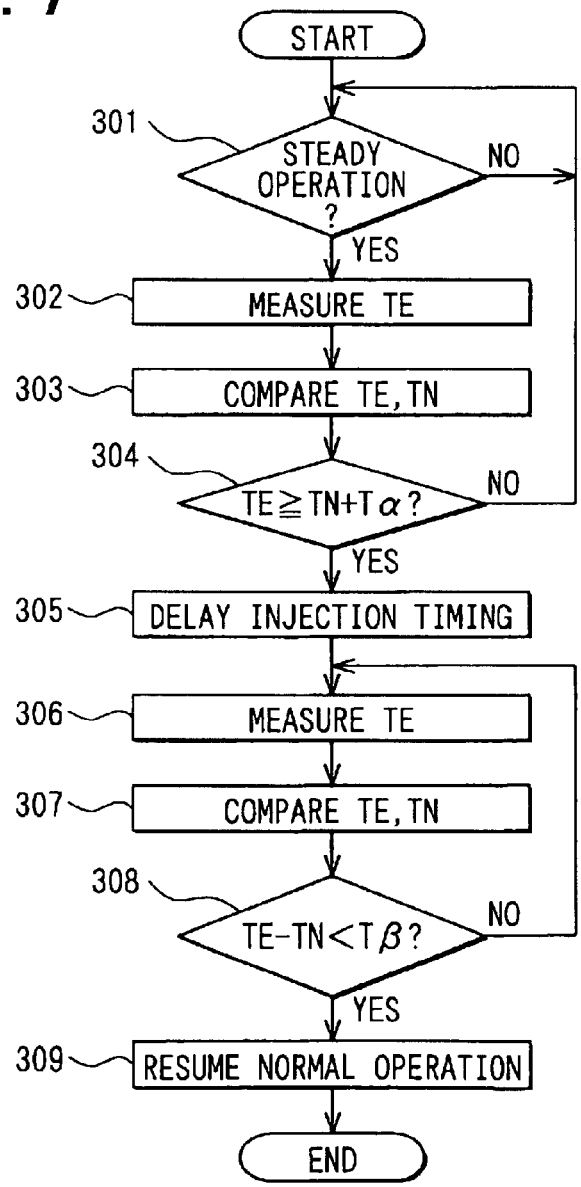
FIG. 7 is a flowchart showing control performed by an ECU according to the third embodiment.

An internal combustion engine 1 having an EGR system according to the third embodiment is illustrated in FIGS. 6 and 7. In order to increase the temperature in the EGR cooler 6 and to regenerate the cooling performance, the EGR system according to the third embodiment delays the fuel injection timing from the usual injection timing as shown in FIG. 6. A broken line LN in FIG. 6 shows a nozzle lifting degree of the fuel injection nozzle at the usual fuel injection timing and a solid line LD in FIG. 6 shows the nozzle lifting degree at the delayed fuel injection timing. In this case too, like the case of the multi-injection, part of combustion energy is converted into the thermal energy of the exhaust gas (not into the motive energy). As a result, the temperature of the exhaust gas is increased and the soot or the unburned hydrocarbon is eliminated by the oxidization.

Next, a processing performed by the ECU 7 according to the third embodiment will be explained based on a flowchart shown in FIG. 7. First, in Step 301, it is determined whether the engine 1 is in the steady operating state or not. If the result of Step 301 is "YES", the processing proceeds to Step 302 and the EGR outlet gas temperature TE is measured. Then, in Step 303, the measured EGR outlet gas temperature TE is compared with the normal EGR outlet gas temperature TN. Then, in Step 304, it is determined whether the cooling performance is degraded or not like the first embodiment. If the result of Step 304 is "YES", the processing proceeds to Step 305.

In Step 305, the ECU 7 delays the fuel injection timing of the fuel injection valves 12 from the usual fuel injection timing in order to increase the temperature of the exhaust gas. Thus, the high-temperature exhaust gas is introduced to the EGR cooler 6 to eliminate the soot or the unburned fuel by the oxidization. Then, in Step 306, the EGR outlet gas temperature TE is measured again. Then, in Step 307, the measured EGR outlet gas temperature TE is compared with the normal EGR outlet gas temperature TN. Then, in Step 308, it is determined whether the cooling performance is regenerated or not like the first embodiment. If the result of Step 308 is "YES", the normal operation is resumed in Step 309, and the processing is ended.

(Fourth Embodiment)

Figure 8:
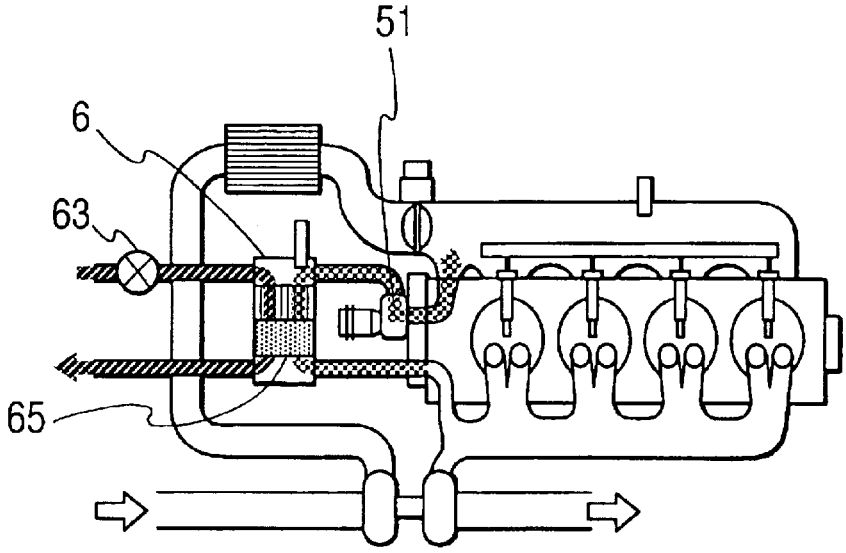
FIG. 8 is a schematic diagram showing an internal combustion engine having an EGR system according to a fourth embodiment of the present invention.
Figure 9:
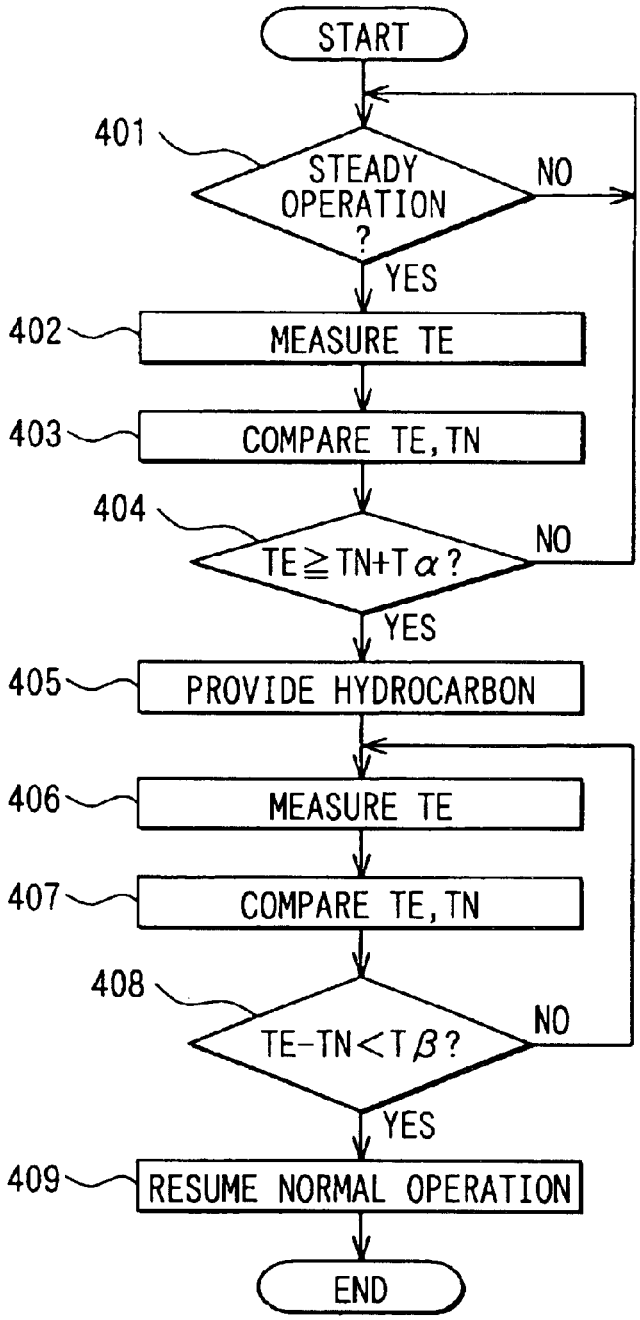
FIG. 9 is a flowchart showing control performed by an ECU according to the fourth embodiment.

An internal combustion engine 1 having an EGR system according to the fourth embodiment is illustrated in FIGS. 8 and 9. In the fourth embodiment, an oxidization catalyst 65 is disposed in an inlet of the EGR cooler 6. The oxidization catalyst 65 is made by forming an oxidization layer on the EGR passage walls upstream of the heat-exchanging part of the EGR cooler 6, for instance. When the cooling performance detecting means of the ECU 7 determines that the cooling performance is degraded, the unburned hydrocarbon is provided to the oxidization catalyst 65. Thus, the unburned hydrocarbon is combusted in a catalytic reaction, and the temperature of the exhaust gas is increased. The unburned hydrocarbon fraction included in the exhaust gas is increased by performing the multi-injection or by restricting the flow rate of the intake air, or by delaying the injection timing, for instance, as explained above. Thus, the increased quantity of the unburned hydrocarbon is provided to the oxidization catalyst 65.

Since the oxidization catalyst 65 is disposed in the EGR system, the quantity of the unburned hydrocarbon reaching the inlet of the EGR cooler 6 is reduced. Therefore, the degradation of the cooling performance is relatively inhibited. However, part of the unburned hydrocarbon slips the oxidization catalyst 65 and deposits in the EGR cooler 6. Specifically, the substantially most part of the soot fraction cannot be combusted fully at the oxidization catalyst 65, and deposits in the EGR cooler 6. Therefore, the temperature of the exhaust gas has to be increased by providing the unburned hydrocarbon.

Next, a processing performed by the ECU 7 according to the fourth embodiment will be explained based on a flowchart shown in FIG. 9. First, in Step 401, it is determined whether the engine 1 is in the steady operating state or not. If the result of Step 401 is "YES", the processing proceeds to Step 402 and the EGR outlet gas temperature TE is measured. Then, in Step 403, the measured EGR outlet gas temperature TE is compared with the normal EGR outlet gas temperature TN. Then, in Step 404, it is determined whether the cooling performance is degraded or not like the first embodiment. If the result of Step 404 is "YES", the processing proceeds to Step 405.

In Step 405, the ECU 7 performs the multi-injection or the restriction of the flow rate of the intake air, or delays the injection timing, in order to increase the quantity of the unburned hydrocarbon included in the exhaust gas. The unburned hydrocarbon is combusted in the catalytic combustion at the oxidization catalyst 65. Thus, the high-temperature exhaust gas is introduced to the EGR cooler 6 to eliminate the soot or the unburned fuel by the oxidization. Then, in Step 406, the EGR outlet gas temperature TE is measured again. Then, in Step 407, the measured EGR outlet gas temperature TE is compared with the normal EGR outlet gas temperature TN. Then, in Step 408, it is determined whether the cooling performance is regenerated or not like the first embodiment. If the result of Step 408 is "YES", the normal operation is resumed in Step 409, and the processing is ended.

(Fifth Embodiment)

Figure 10:
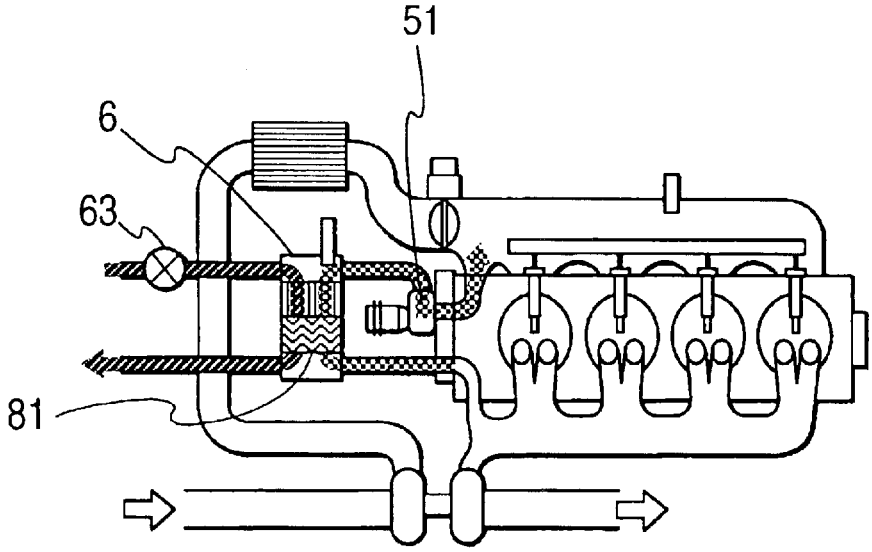
FIG. 10 is a schematic diagram showing an internal combustion engine having an EGR system according to a fifth embodiment of the present invention.
Figure 11:
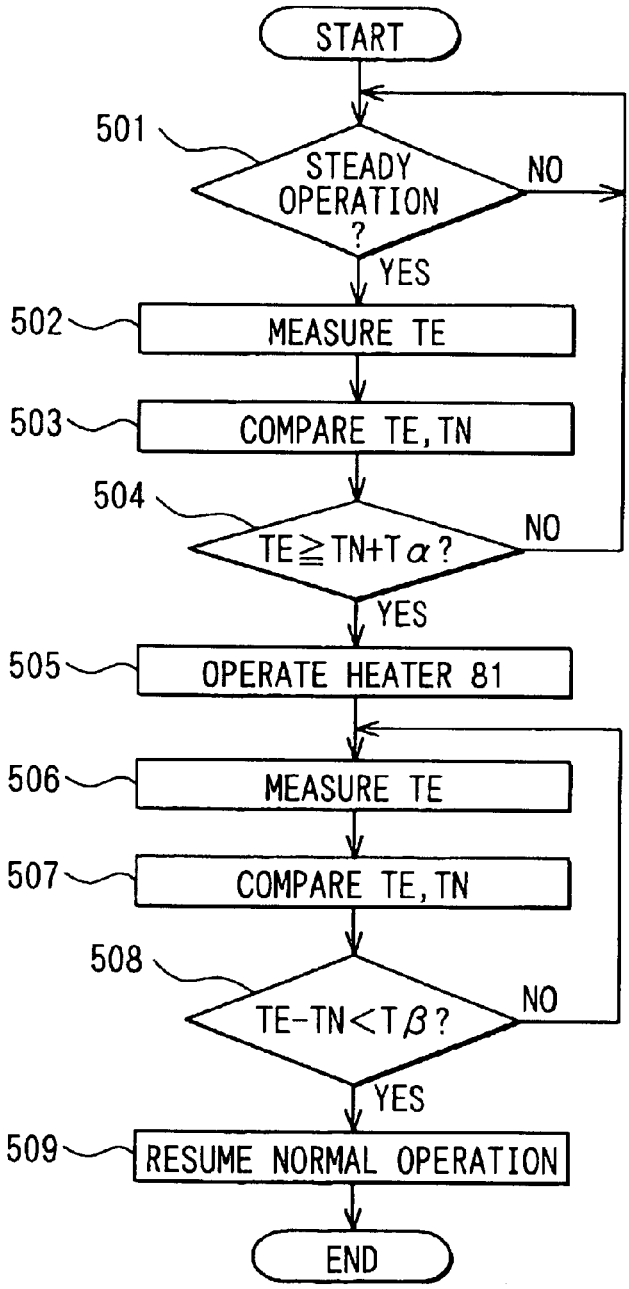
FIG. 11 is a flowchart showing control performed by an ECU according to the fifth embodiment.

An internal combustion engine 1 having an EGR system according to the fifth embodiment is illustrated in FIGS. 10 and 11. The EGR system according to the fifth embodiment has heating means such as a heater 81 in the inlet of the EGR cooler 6. The heater 81 is disposed in the EGR cooler 6 and upstream of the heat-exchanging part, for instance. When the cooling performance detecting means of the ECU 7 determines that the cooling performance is degraded, the heater 81 is operated by energization and the like to increase the temperature of the exhaust gas.

Next, a processing performed by the ECU 7 according to the fifth embodiment will be explained based on a flowchart shown in FIG. 11. First, in Step 501, it is determined whether the engine 1 is in the steady operating state or not. If the result of Step 501 is "YES", the processing proceeds to Step 502 and the EGR outlet gas temperature TE is measured. Then, in Step 503, the measured EGR outlet gas temperature TE is compared with the normal EGR outlet gas temperature TN. Then, in Step 504, it is determined whether the cooling performance is degraded or not like the first embodiment. If the result of Step 504 is "YES", the processing proceeds to Step 505.

In Step 505, the ECU 7 operates the heater 81 to heat the exhaust gas. Thus, the high-temperature exhaust gas is introduced to the EGR cooler 6 to eliminate the soot or the unburned fuel by the oxidization. Then, in Step 506, the EGR outlet gas temperature TE is measured again. Then, in Step 507, the measured EGR outlet gas temperature TE is compared with the normal EGR outlet gas temperature TN. Then, in Step 508, it is determined whether the cooling performance is regenerated or not like the first embodiment. If the result of Step 508 is "YES", the normal operation is resumed in Step 509, and the processing is ended.

(Sixth Embodiment)

Figure 12:
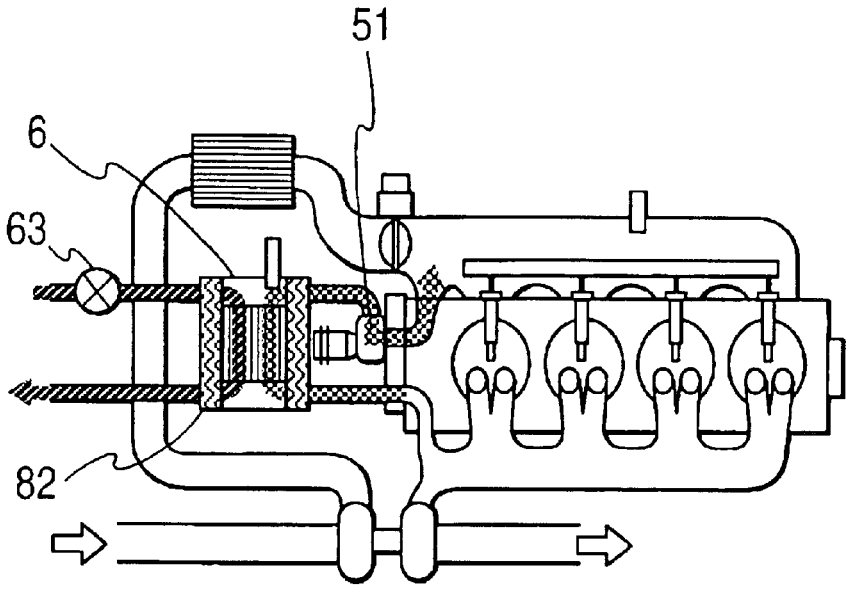
FIG. 12 is a schematic diagram showing an internal combustion engine having an EGR system according to a sixth embodiment of the present invention.
Figure 13:
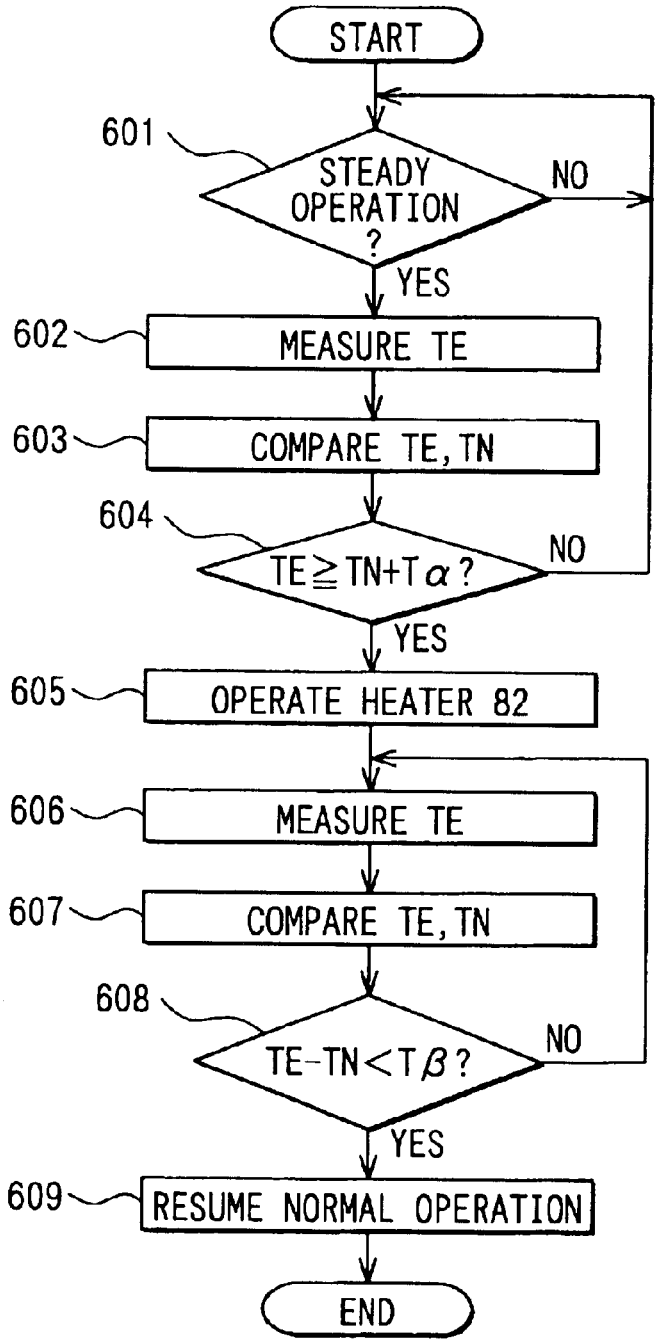
FIG. 13 is a flowchart showing control performed by an ECU according to the sixth embodiment.

An internal combustion engine 1 having an EGR system according to the sixth embodiment is illustrated in FIGS. 12 and 13. Heating means such as a heater 82 can be disposed outside the EGR cooler 6 according to the sixth embodiment. The heater 82 is disposed outside the heat-exchanging part of the EGR cooler 6, for instance, and is capable of efficiently heating the entire heat-exchanging part. When the cooling performance detecting means determines that the cooling performance is degraded, the heater 82 is operated by energization and the like in order to increase the temperature of the exhaust gas.

Next, a processing performed by the ECU 7 according to the sixth embodiment will be explained based on a flowchart shown in FIG. 13. First, in Step 601, it is determined whether the engine 1 is in the steady operating state or not like the first embodiment. If the result of Step 601 is "YES", the processing proceeds to Step 602 and the EGR outlet gas temperature TE is measured. Then, in Step 603, the measured EGR outlet gas temperature TE is compared with the normal EGR outlet gas temperature TN. Then, in Step 604, it is determined whether the cooling performance is degraded or not like the first embodiment. If the result of Step 604 is "YES", the processing proceeds to Step 605.

In Step 605, the ECU 7 operates the heater 82 to heat the exhaust gas. Thus, the high-temperature exhaust gas is introduced to the EGR cooler 6 to eliminate the soot or the unburned fuel by the oxidization. Then, in Step 606, the EGR outlet gas temperature TE is measured again. Then, in Step 607, the measured EGR outlet gas temperature TE is compared with the normal EGR outlet gas temperature TN. Then, in Step 608, it is determined whether the cooling performance is regenerated or not like the first embodiment. If the result of Step 608 is "YES", the normal operation is resumed in Step 609, and the processing is ended.

(Seventh Embodiment)

Figure 14:
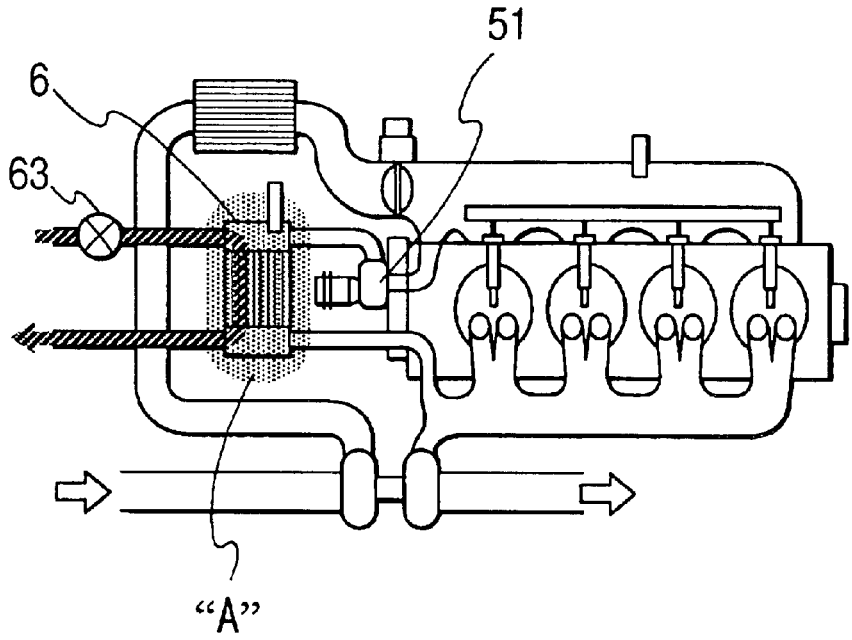
FIG. 14 is a schematic diagram showing an internal combustion engine having an EGR system according to a seventh embodiment of the present invention.
Figure 15:
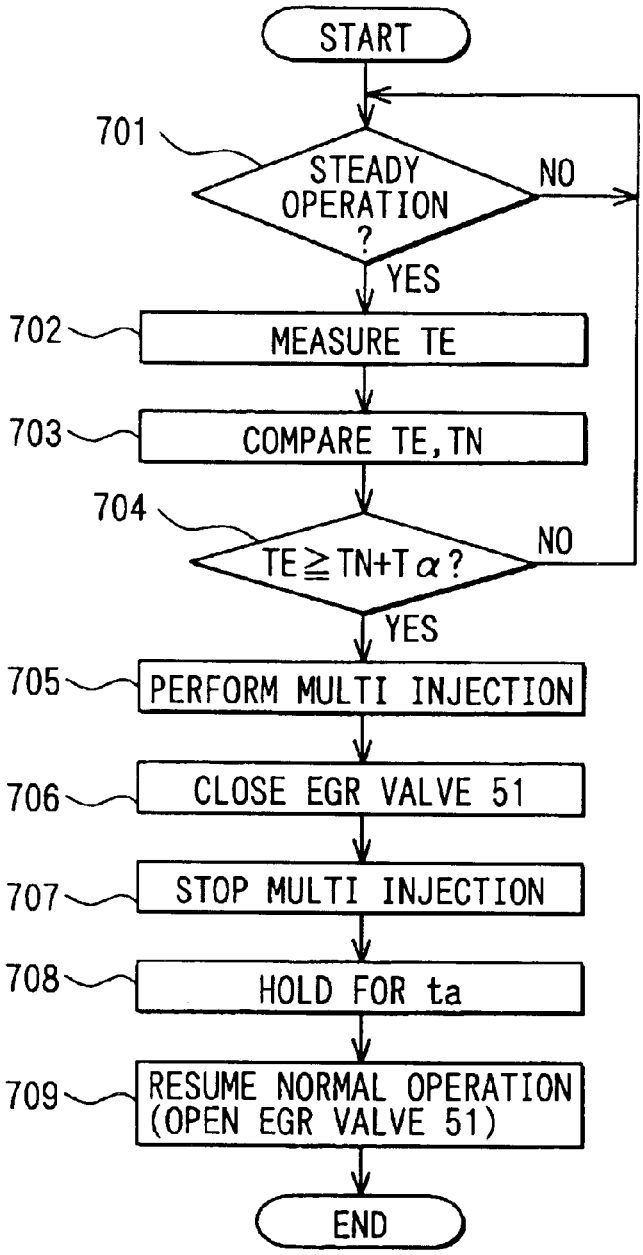
FIG. 15 is a flowchart showing control performed by an ECU according to the seventh embodiment.

An internal combustion engine having an EGR system according to the seventh embodiment is illustrated in FIGS. 14 and 15. The cooling performance regeneration controlling means of the ECU 7 according to the seventh embodiment performs the multi-injection to increase the temperature of the exhaust gas like the first embodiment. Meanwhile, the cooling performance regeneration controlling means stops the recirculation of the EGR gas by closing the EGR valve 51 disposed downstream of the EGR cooler 6 as shown in FIG. 14. Thus, the high-temperature exhaust gas is kept in the EGR cooler 6. A meshed area "A" in FIG. 14 shows a high-temperature area around the EGR cooler 6. As a result, the temperature in the EGR cooler 6 is maintained high, even if the multi-injection for heating the exhaust gas is stopped.

When the exhaust gas is maintained at a high temperature for a long time in order to regenerate the cooling performance, fuel consumption may be increased. In contrast to it, in the embodiment, the temperature in the EGR cooler 6 can be maintained high for a long time with a short heating period. As a result, increase in the fuel consumption is inhibited, while regenerating the cooling performance by efficiently eliminating the soot or the unburned hydrocarbon. This scheme can be applied to any cases in which the exhaust gas is heated like the above embodiments or the EGR cooler 6 is heated, other than the first embodiment. Likewise, the EGR valve 51 is closed to shorten the heating period, improving the energy efficiency.

Next, a processing performed by the ECU 7 according to the seventh embodiment will be explained based on a flowchart shown in FIG. 15. First, in Step 701, it is determined whether the engine 1 is in the steady operating state or not like the first embodiment. If the result of Step 701 is "YES", the processing proceeds to Step 702 and the EGR outlet gas temperature TE is measured. Then, in Step 703, the measured EGR outlet gas temperature TE is compared with the normal EGR outlet gas temperature TN. Then, in Step 704, it is determined whether the cooling performance is degraded or not like the first embodiment. If the result of Step 704 is "YES", the processing proceeds to Step 705.

In Step 705, the ECU 7 performs the multi-injection to increase the temperature of the exhaust gas. Thus, the high-temperature exhaust gas is introduced to the EGR cooler 6. Then the ECU 7 closes the EGR valve 51 in Step 706 to keep the high-temperature exhaust gas in the EGR cooler 6. Then in Step 707, the ECU 7 stops the temperature increasing control, which is performed with the multi-injection. Then in Step 708, the state is held for a predetermined period ta enough to eliminate the soot or the unburned hydrocarbon. Then, in Step 709, the EGR valve 51 is opened and the normal operation is resumed. Then, the processing is ended.

(Eighth Embodiment)

Figure 16:
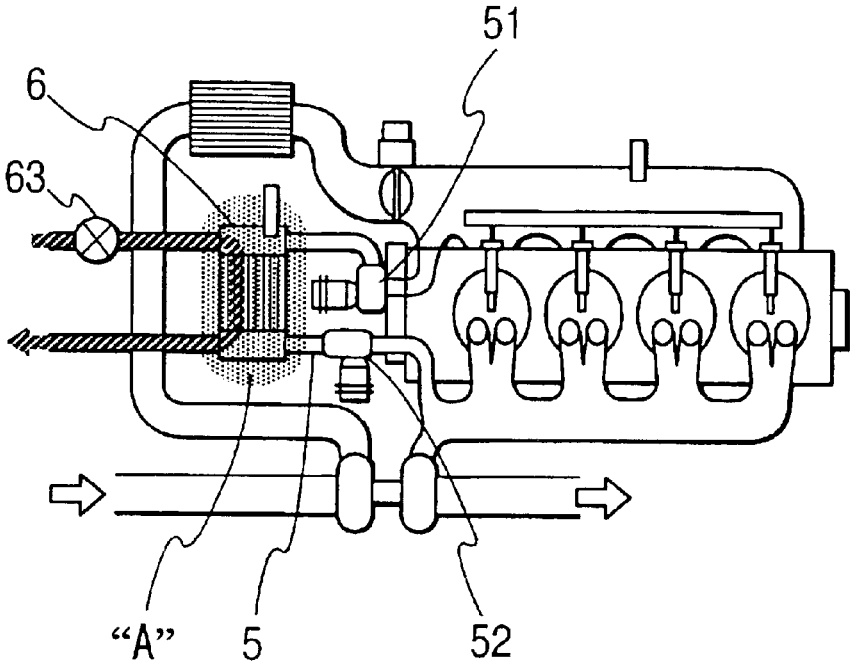
FIG. 16 is a schematic diagram showing an internal combustion engine having an EGR system according to an eighth embodiment of the present invention.
Figure 17:
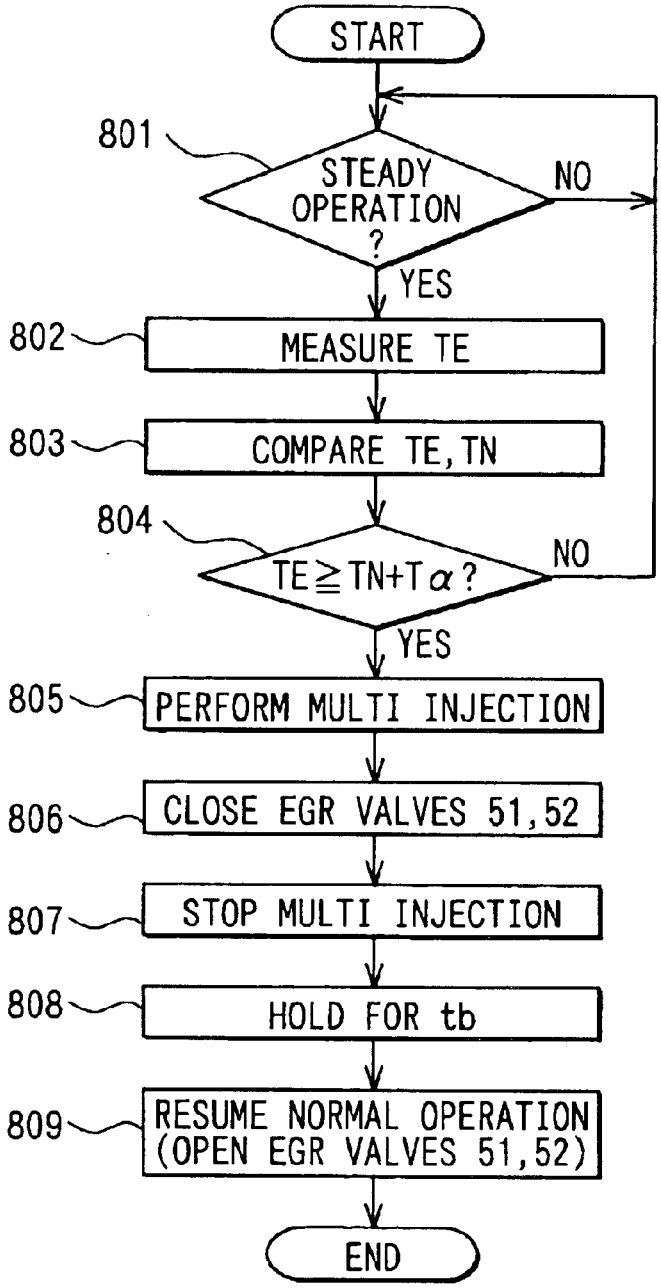
FIG. 17 is a flowchart showing control performed by an ECU according to the eighth embodiment.

An internal combustion engine 1 having an EGR system according to the eighth embodiment is illustrated in FIGS. 16 and 17. The EGR system according to the eighth embodiment has an EGR valve 52 in the EGR passage 5 upstream of the EGR cooler 6 in addition, in order to reduce the fuel consumption. In the embodiment, the cooling performance regeneration controlling means of the ECU 7 increases the temperature of the exhaust gas by the multi-injection like the seventh embodiment. Then, the cooling performance regeneration controlling means closes the EGR valve 51. Meanwhile, the cooling performance regeneration controlling means closes the EGR valve 52 disposed in the inlet side of the EGR cooler 6. Thus, the recirculation of the EGR gas is stopped. Accordingly, heat-retaining property during the cooling performance regenerating operation is further improved, and the increase in the fuel consumption is inhibited more effectively. A meshed area "A" in FIG. 16 shows a high-temperature area at the time when the EGR valves 51, 52 are closed. As a result, the cooling performance is regenerated by eliminating the soot and the unburned hydrocarbon more efficiently.

Next, a processing performed by the ECU 7 according to the eighth embodiment will be explained based on a flowchart shown in FIG. 17. First, in Step 801, it is determined whether the engine 1 is in the steady operating state or not like the first embodiment. If the result of Step 801 is "YES", the processing proceeds to Step 802 and the EGR outlet gas temperature TE is measured. Then, in Step 803, the measured EGR outlet gas temperature TE is compared with the normal EGR outlet gas temperature TN. Then, in Step 804, it is determined whether the cooling performance is degraded or not like the first embodiment. If the result of Step 804 is "YES", the processing proceeds to Step 805.

In Step 805, the ECU 7 increases the temperature of the exhaust gas by performing the multi-injection. Thus, the high-temperature exhaust gas is introduced to the EGR cooler 6. Then the ECU 7 closes the EGR valves 51, 52 in Step 806 to confine the high-temperature exhaust gas in the EGR cooler 6. Then in Step 807, the ECU 7 stops the temperature increasing control, which is performed with the multi-injection. Then in Step 808, the state is held for a predetermined period tb enough to eliminate the soot or the unburned hydrocarbon. Then, in Step 809, the EGR valves 51, 52 are opened and the normal operation is resumed. Then, the processing is ended.

(Ninth Embodiment)

Figure 18:
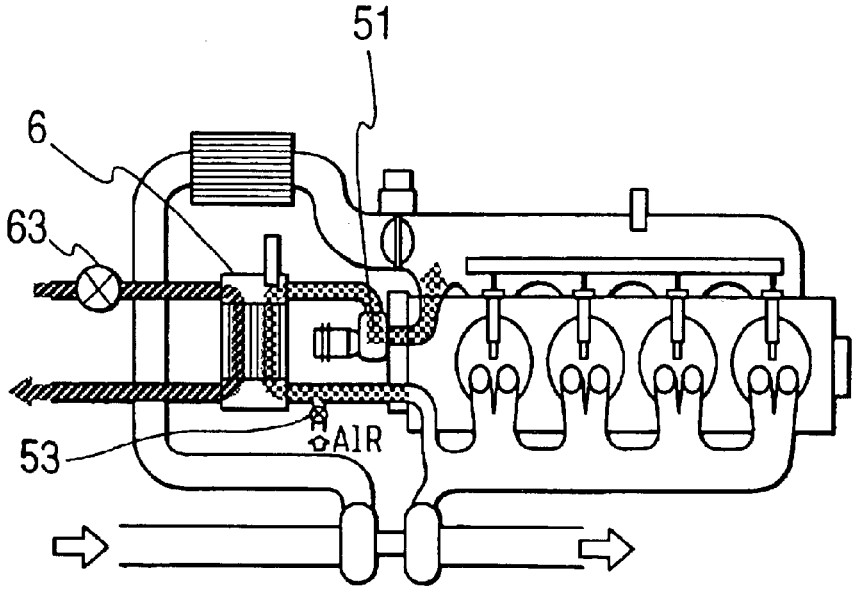
FIG. 18 is a schematic diagram showing an internal combustion engine having an EGR system according to a ninth embodiment of the present invention.
Figure 19:
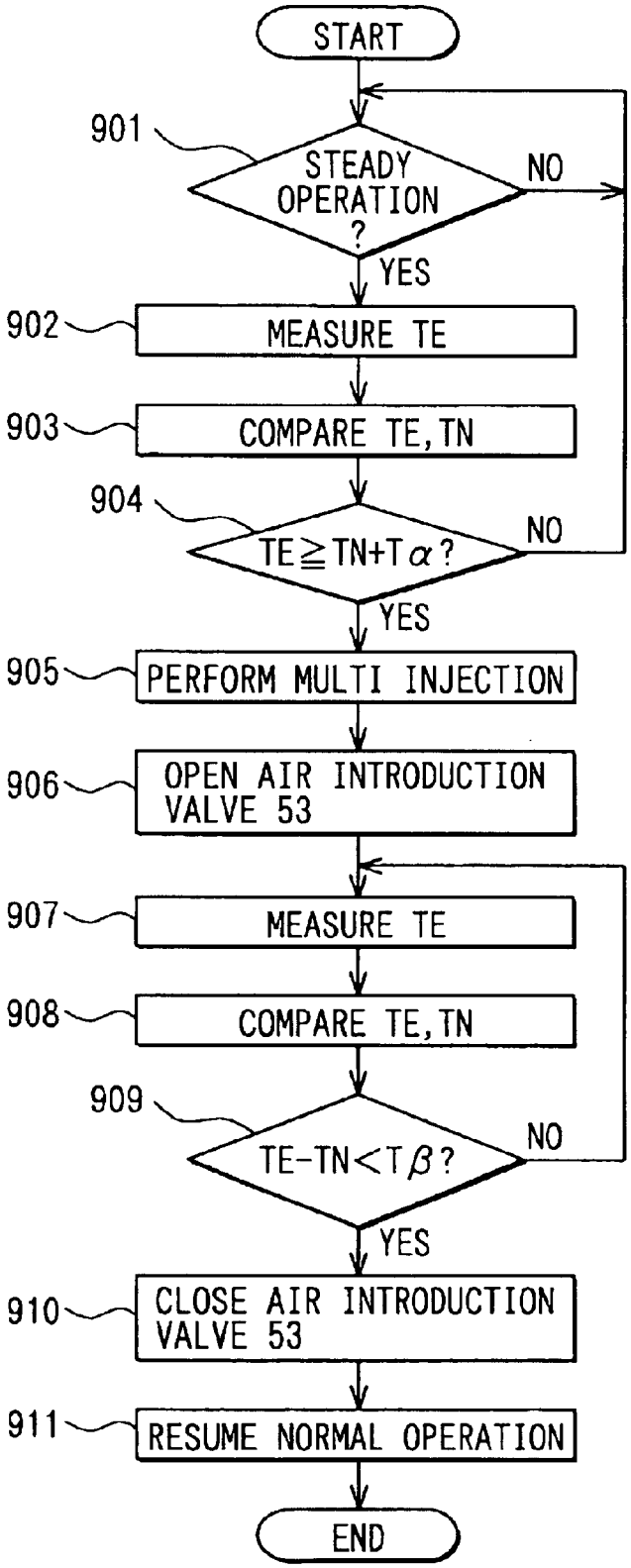
FIG. 19 is a flowchart showing control performed by an ECU according to the ninth embodiment.

An internal combustion engine 1 having an EGR system according to the ninth embodiment is illustrated in FIGS. 18 and 19. The EGR system according to the ninth embodiment has an air introduction valve 53 in the EGR passage 5 and upstream of the EGR cooler 6. The air introduction valve 53 introduces the air into the EGR cooler 6. The cooling performance regeneration controlling means of the ECU 7 increases the temperature of the exhaust gas by performing the multi-injection like the first embodiment. Meanwhile, the cooling performance regeneration controlling means opens the air introduction valve 53 to provide the air into the EGR cooler 6. Thus, the concentration of oxygen in the EGR cooler 6 is increased, and the oxidization of the soot or the unburned hydrocarbon is accelerated. As a result, the cooling performance is regenerated in a short time.

Next, a processing performed by the ECU 7 according to the ninth embodiment will be explained based on a flowchart shown in FIG. 19. First, in Step 901, it is determined whether the engine 1 is in the steady operating state or not like the first embodiment. If the result of Step 901 is "YES", the processing proceeds to Step 902 and the EGR outlet gas temperature TE is measured. Then, in Step 903, the measured EGR outlet gas temperature TE is compared with the normal EGR outlet gas temperature TN. Then, in Step 904, it is determined whether the cooling performance is degraded or not like the first embodiment. If the result of Step 904 is "YES", the processing proceeds to Step 905.

In Step 905, the ECU 7 increases the temperature of the exhaust gas by performing the multi-injection and introduces the high-temperature exhaust gas into the EGR cooler 6. Then, in Step 906, the ECU 7 opens the air introduction valve 53 to introduce the air into the EGR cooler 6 and to accelerate the oxidization and the combustion of the soot or the unburned hydrocarbon. Then, in Step 907, the EGR outlet gas temperature TE is measured again. Then, in Step 908, the measured EGR outlet gas temperature TE is compared with the normal EGR outlet gas temperature TN. Then, in Step 909, it is determined whether the cooling performance is regenerated or not like the first embodiment. If the result of Step 909 is "YES", the air introduction valve 53 is closed to stop the introduction of the air into the EGR cooler 6 in Step 910. Then, the normal operation is resumed in Step 911, and the processing is ended.

(Tenth Embodiment)

Figure 20:
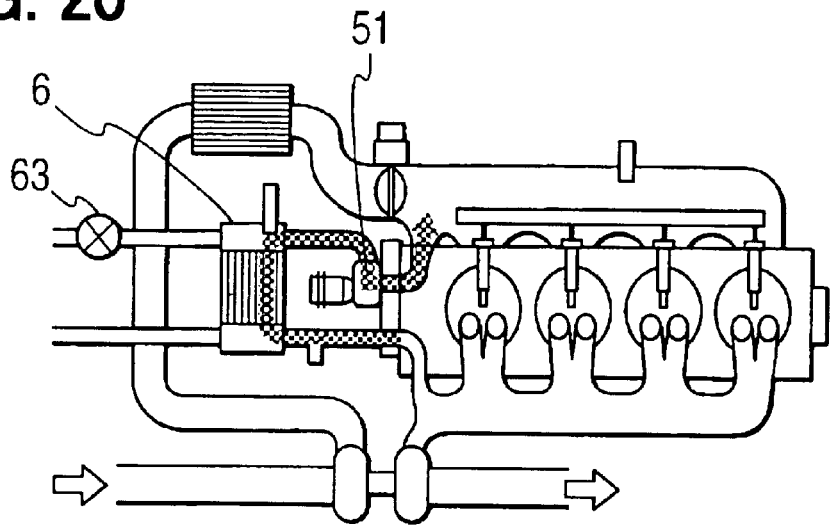
FIG. 20 is a schematic diagram showing an internal combustion engine having an EGR system according to a tenth embodiment of the present invention.
Figure 21:
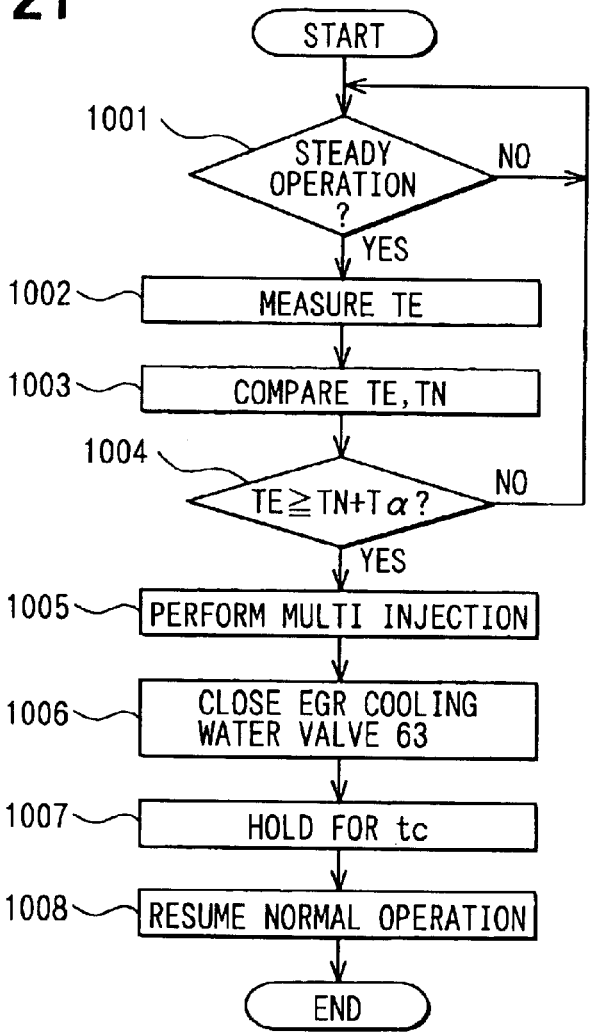
FIG. 21 is a flowchart showing control performed by an ECU according to the tenth embodiment.

An internal combustion engine 1 having an EGR system according to the tenth embodiment is illustrated in FIGS. 20 and 21. In the EGR system according to the tenth embodiment, the cooling performance regeneration controlling means of the ECU 7 performs the multi-injection to increase the temperature of the exhaust gas like the first embodiment. Meanwhile, the cooling performance regeneration controlling means closes the EGR cooling water valve 63 to stop the recirculation of the EGR cooling water. Thus, the heat of the high-temperature exhaust gas in the EGR cooler 6 is prevented from flowing out, since the exchange of the heat between the exhaust gas and the EGR cooling water is inhibited. As a result, the oxidization of the soot or the unburned hydrocarbon is accelerated, and the cooling performance is regenerated in a short time.

Next, a processing performed by the ECU 7 according to the tenth embodiment will be explained based on a flowchart shown in FIG. 21. First, in Step 1001, it is determined whether the engine 1 is in the steady operating state or not like the first embodiment. If the result of Step 1001 is "YES", the processing proceeds to Step 1002 and the EGR outlet gas temperature TE is measured. Then, in Step 1003, the measured EGR outlet gas temperature TE is compared with the normal EGR outlet gas temperature TN. Then, in Step 1004, it is determined whether the cooling performance is degraded or not like the first embodiment. If the result of Step 1004 is "YES", the processing proceeds to Step 1005.

In Step 1005, the ECU 7 performs the multi-injection to increase the temperature of the exhaust gas. Thus, the high-temperature exhaust gas is introduced to the EGR cooler 6. Then the ECU 7 closes the EGR cooling water valve 63 in Step 1006 to maintain the inside of the EGR cooler 6 at a high temperature and to accelerate the oxidization and the combustion of the soot or the unburned hydrocarbon. Then in Step 1007, the ECU 7 holds the state for a predetermined period tc enough to eliminate the soot or the unburned hydrocarbon. Then, in Step 1008, the EGR cooling water valve 63 is opened and the normal operation is resumed. Then, the processing is ended.

(Eleventh Embodiment)

Figure 22:
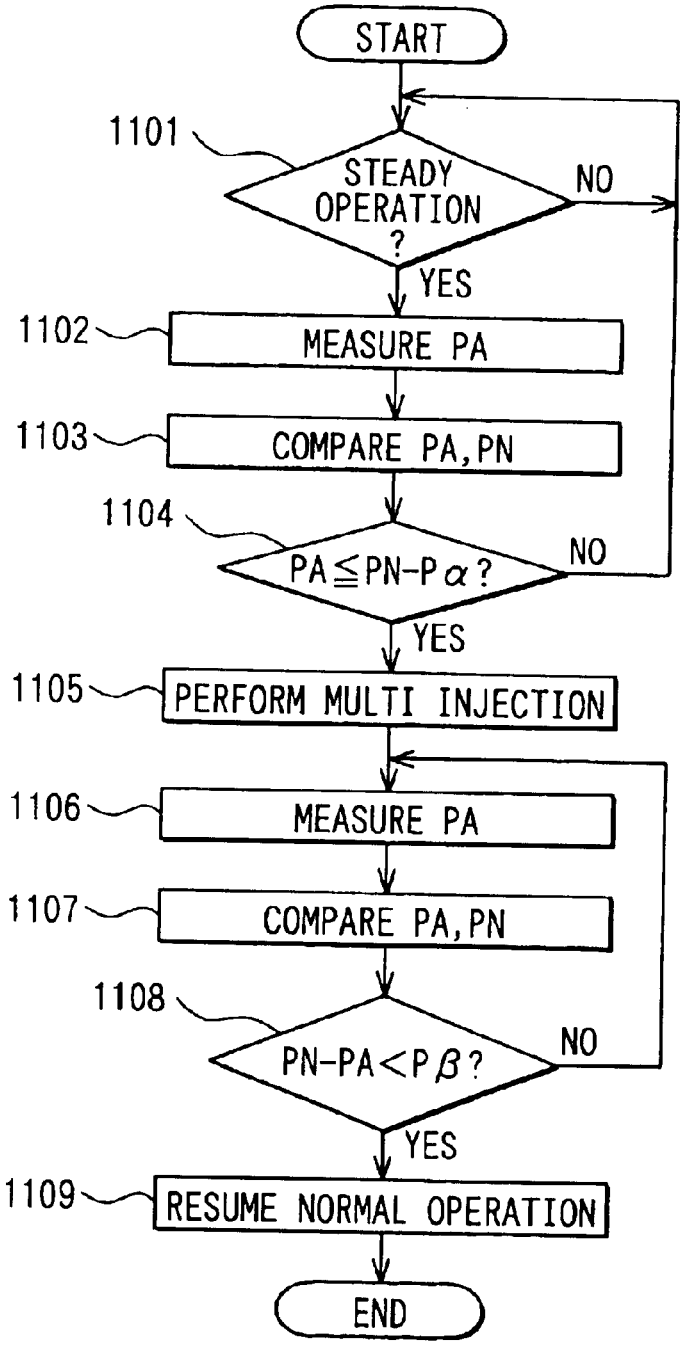
FIG. 22 is a flowchart showing control performed by an ECU according to an eleventh embodiment of the present invention.

An internal combustion engine having an EGR system according to the eleventh embodiment is illustrated in FIG. 22. The EGR system according to the eleventh embodiment determines the degradation of the cooling performance based on the pressure of the intake air (intake pressure). More specifically, cooling performance detecting means of the ECU 7 determines that the cooling performance is degraded when the intake pressure, which is measured by the intake pressure sensor 24, is lower than a normal intake pressure by at least a predetermined value. The normal intake pressure is estimated from the operating state of the engine 1, which is detected based on the signals from the various sensors.

The cooling performance regeneration controlling means performs the regenerating operation for regenerating the cooling performance when the cooling performance detecting means determines that the cooling performance is degraded. More specifically, the cooling performance regeneration controlling means oxidizes and eliminates the soot or the unburned fuel adhering to the EGR passage walls, for instance, by increasing the temperature in the EGR cooler 6 temporarily, like the above embodiments. Then, the regenerating operation is ended when the intake pressure reaches a certain range relative to the normal intake pressure, which is estimated from the operating state of the engine 1.

Next, a processing performed by the ECU 7 according to the eleventh embodiment will be explained based on a flowchart shown in FIG. 22. The ECU 7 repeatedly performs the processing at predetermined time intervals. If the processing is started, it is determined whether the engine 1 is in a steady operating state or not in Step 1101. Whether the engine 1 is in the steady operating state or not is determined based on whether a change of the engine rotation speed, a fuel injection quantity or the like from the previous processing is less than a predetermined value or not, for instance. If the result of Step 1101 is "YES", the processing proceeds to Step 1102, and intake pressure PA measured by the intake pressure sensor 24 is inputted. If the result of Step 1101 is "NO", the processing returns to the start (START).

The intake pressure PA inputted in Step 1102 is compared with the normal intake pressure PN in Step 1103. The ECU 7 estimates in advance the intake pressure in a state in which there is no soot or hydrocarbon adhering to the inner wall of the EGR cooler 6, and stores the estimated intake pressure as the normal intake pressure PN. Then, in Step 1104, it is determined whether the measured intake pressure PA is lower than the normal intake pressure PN by at least a predetermined value $P\alpha$ or not. If the result of Step 1104 is "YES", it is determined that the cooling performance is degraded, and the processing proceeds to Step 1105. If the result of Step 1104 is "NO", it is determined that the EGR cooler is operating normally, and the processing returns to the start.

In Step 1105, the ECU 7 sends the injection signal to the fuel injection valves 12 so that the fuel injection valves perform the multi-injection as shown in FIG. 2. Thus, the exhaust gas is heated and the high-temperature exhaust gas is introduced to the EGR cooler 6. Thus, the oxidization of the soot or the unburned hydrocarbon adhering to the EGR passage walls is promoted, and the oxides are led to the intake system with the exhaust gas. Then, in Step 1106, the intake pressure PA is measured again. Then, in Step 1107, the measured intake pressure PA is compared with the normal intake pressure PN. Then, in Step 1108, it is determined whether a difference between the normal intake pressure PN and the measured intake pressure PA is less than another predetermined value $P\beta$ or not. If the result of Step 1108 is "YES", it is determined that the soot or the unburned hydrocarbon is eliminated by the oxidization and the cooling performance is regenerated. Then in Step 1109, the normal operation is resumed, and the processing is ended. If the result of Step 1108 is "NO", Step 1106 and the following steps are repeated.

As explained above, in the embodiments, the degradation of the cooling performance is detected based on the EGR outlet gas temperature or the intake pressure, and meanwhile, the temperature of the exhaust gas is increased or the EGR cooler is heated. Thus, the soot or the unburned hydrocarbon adhering to the heat exchanging part is eliminated easily and effectively. The operations according to the above embodiments can be combined with each other. Thus, high performance of the exhaust gas recirculation is maintained for a long time, and the degradation of the emission, which is caused in the long-term use, is prevented.

In the embodiments, the regenerating operation for regenerating the cooling performance is ended when the cooling performance is determined to be regenerated. Alternatively, the regenerating operation may be ended when a predetermined period passes since the regenerating operation is started.

The present invention should not be limited to the disclosed embodiments, but may be implemented in many other ways without departing from the spirit of the invention.

What is claimed is:

1. An exhaust gas recirculation system of an internal combustion engine having an exhaust gas recirculation cooler that is disposed in an exhaust gas recirculation passage and cools exhaust gas recirculated from an exhaust passage to an intake passage of the engine through the exhaust gas recirculation passage connecting the exhaust passage with the intake passage, the system comprising:

cooling performance detecting means for detecting cooling performance of the cooler;

cooling performance regeneration controlling means for performing a regenerating operation for regenerating the cooling performance of the cooler when the cooling performance detecting means detects degradation of the cooling performance; and intake pressure measuring means for measuring pressure of intake air, wherein the cooling performance detecting means determines that the cooling performance is degraded when the intake pressure measured by the intake pressure measuring means is lower than a normal intake pressure by at least a predetermined value, the normal intake pressure being estimated from an operating state of the engine.

2. The exhaust gas recirculation system as in claim 1, wherein the cooling performance detecting means detects the cooling performance while the engine is operating steadily.

3. The exhaust gas recirculation system as in claim 2, wherein the cooling performance regeneration controlling means increases temperature of the exhaust gas by driving an intake throttle toward a closing direction from a usual position when the cooling performance detecting means detects the degradation of the cooling performance, the intake throttle being disposed in the intake passage.

4. The exhaust gas recirculation system as in claim 2, wherein the cooling performance regeneration controlling means increases temperature of the exhaust gas by delaying timing of fuel injection to the engine when the cooling performance detecting means detects the degradation of the cooling performance.

5. The exhaust gas recirculation system as in claim 2, further comprising an oxidization catalyst, which is disposed in an inlet of the cooler or is supported on a wall of a heat exchanging part of the cooler, wherein the cooling performance regeneration controlling means increases temperature of the exhaust gas introduced into the cooler by providing fuel to the catalyst to combust the fuel in catalytic combustion when the cooling performance detecting means detects the degradation of the cooling performance.

6. The exhaust gas recirculation system as in claim 2, further comprising heating means disposed outside the cooler, wherein the cooling performance regeneration controlling means operates the heating means to increase the temperature of the exhaust gas introduced into the cooler when the cooling performance detecting means detects the degradation of the cooling performance.

7. The exhaust gas recirculation system as in any one of claims 3 to 6, further comprising a first exhaust gas recirculation valve disposed in the exhaust gas recirculation passage and downstream of the cooler, wherein the cooling performance regeneration controlling means temporarily increases the temperature inside the cooler and stops the recirculation of the exhaust gas by closing the first exhaust gas recirculation valve when the cooling performance detecting means detects the degradation of the cooling performance.

8. The exhaust gas recirculation system as in claim 7, further comprising a second exhaust gas recirculation valve disposed in the exhaust gas recirculation passage and upstream of the cooler, wherein the cooling performance regeneration controlling means closes the first and second exhaust gas recirculation valves when the cooling performance detecting means detects the degradation of the cooling performance.

9. The exhaust gas recirculation system as in any one of claims 3 to 6, wherein the cooling performance regeneration controlling means temporarily increases the temperature inside the cooler and introduces air into the cooler when the cooling performance detecting means detects the degradation of the cooling performance.

10. The exhaust gas recirculation system as in any one of claims 3 to 6, wherein the cooling performance regeneration controlling means temporarily increases the temperature inside the cooler and stops a flow of a cooling medium passing through the cooler when the cooling performance detecting means detects the degradation of the cooling performance.

11. The exhaust gas recirculation system as in claim 2, further comprising temperature measuring means for measuring the temperature of the exhaust gas at an outlet of the cooler, wherein the cooling performance regeneration controlling means ends the regenerating operation when the temperature of the exhaust gas measured by the temperature measuring means reaches a predetermined range relative to a normal temperature of the exhaust gas at the outlet of the cooler after the regenerating operation is started, the normal temperature of the exhaust gas at the outlet of the cooler being estimated from the operating state of the engine.

12. The exhaust gas recirculation system as in claim 2, wherein the cooling performance regeneration controlling means ends the regenerating operation when the intake pressure measured by the intake pressure measuring means reaches a predetermined range relative to a normal intake pressure after the regenerating operation is started, the normal intake pressure being estimated from the operating state of the engine.

13. The exhaust gas recirculation system as in claim 2, wherein the cooling performance regeneration controlling means ends the regenerating operation when a predetermined period passes after the regenerating operation is started.

14. The exhaust gas recirculation system as in claim 7, wherein the cooling performance regeneration controlling means stops a flow of a cooling medium passing through the cooler when the cooling performance detecting means detects the degradation of the cooling performance.

15. The exhaust gas recirculation system as in claim 8, wherein the cooling performance regeneration controlling means stops a flow of a cooling medium passing through the cooler when the cooling performance detecting means detects the degradation of the cooling performance.

16. The exhaust gas recirculation system as in claim 9, wherein the cooling performance regeneration controlling means stops a flow of a cooling medium passing through the cooler when the cooling performance detecting means detects the degradation of the cooling performance.

* * * * *